US007323281B2

(12) United States Patent
Emoto et al.

(10) Patent No.: US 7,323,281 B2
(45) **Date of Patent: *Jan. 29, 2008**

(54) TONER, DEVELOPER INCLUDING THE TONER, CONTAINER CONTAINING THE TONER OR THE DEVELOPER AND METHOD OF PRODUCING THE TONER

(75) Inventors: Shigeru Emoto, Shizuoka-ken (JP); Shinichiro Yagi, Shizuoka-ken (JP); Naohito Shimota, Shizuoka-ken (JP); Maiko Kondo, Shizuoka-ken (JP); Fumihiro Sasaki, Shizuoka-ken (JP); Toshiki Nanya, Shizuoka-ken (JP); Hiroto Higuchi, Shizuoka-ken (JP); Masami Tomita, Shizuoka-ken (JP); Tomoyuki Ichikawa, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/529,370

(22) Filed: Sep. 29, 2006

(65) Prior Publication Data

US 2007/0020546 A1 Jan. 25, 2007

Related U.S. Application Data

(63) Continuation of application No. 10/724,260, filed on Dec. 1, 2003, now Pat. No. 7,157,199.

(30) Foreign Application Priority Data

Nov. 29, 2002 (JP) ..... 2002-349008

(51) Int. Cl.
*G03G 9/087* (2006.01)

(52) U.S. Cl. ..... 430/108.22; 430/108.1; 430/108.4; 430/109.4; 430/110.3; 430/110.4; 430/111.4; 430/137.11

(58) Field of Classification Search ..... 430/108.1, 430/108.22, 108.4, 110.3, 110.4, 137.1, 137.17, 430/137.19, 137.11, 110.2, 109.4, 111.4
See application file for complete search history.

(56) References Cited

U.S. PATENT DOCUMENTS 4,980,257 A 12/1990 Anno et al.

(Continued)

FOREIGN PATENT DOCUMENTS

EP 0 523 733 A1 1/1993

(Continued)

OTHER PUBLICATIONS

U.S. Appl. No. 11/519,893, filed Sep. 13, 2006, Inoue et al.
U.S. Appl. No. 11/206,128, filed Aug. 18, 2005, Yamashita et al.
U.S. Appl. No. 11/734,892, filed Apr. 13, 2007, Yamashita et al.

*Primary Examiner*—Janis L. Dote
(74) *Attorney, Agent, or Firm*—Oblon, Spivak, McClelland, Maier & Neustadt, P.C.

(57) ABSTRACT

A toner comprising toner particles comprising a first binder resin; a second binder resin different from said first binder resin and having a glass transition temperature of from 40 to 55° C.; a colorant; and a release agent, and a particulate resin material which is located on surface of the toner particles with a coverage of from 50 to 100%, and which has a glass transition temperature of from 50 to 90° C., wherein a weight ratio (W2/W1) between the second binder resin (W2) and the first binder resin (W1) is from 5/95 to 40/60, and wherein a ratio (G'80/G'180) between a storage modulus of the toner at 80° C. (G'80) and a storage modulus at 180° C. (G'180) is from 100 to 1,000.

17 Claims, 2 Drawing Sheets

U.S. PATENT DOCUMENTS

| | | | | |
|---|---|---|---|---|
| 5,225,304 | A | 7/1993 | Kabashima et al. | |
| 5,461,089 | A | 10/1995 | Handyside et al. | 523/171 |
| 5,747,210 | A | 5/1998 | Emoto et al. | |
| 6,395,443 | B2 | 5/2002 | Kuroda et al. | |
| 6,597,883 | B2 | 7/2003 | Muramatsu et al. | 399/258 |
| 6,660,443 | B2 | 12/2003 | Sugiyama et al. | |
| 6,682,866 | B2 | 1/2004 | Sugiyama et al. | |
| 6,740,460 | B2 | 5/2004 | Tomita et al. | |
| 6,756,175 | B2 | 6/2004 | Emoto et al. | |
| 6,787,280 | B2 | 9/2004 | Yamashita et al. | |
| 6,800,412 | B2 | 10/2004 | Sugiyama et al. | |
| 6,824,945 | B2 | 11/2004 | Emoto et al. | |
| 6,835,519 | B2 | 12/2004 | Sugiyama et al. | |
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 6,936,390 | B2 | 8/2005 | Nanya et al. | |
| 7,056,636 | B2 | 6/2006 | Tomita et al. | |
| 7,056,638 | B1 | 6/2006 | Tomita et al. | |
| 7,083,890 | B2 | 8/2006 | Emoto et al. | |
| 7,157,199 | B2 * | 1/2007 | Emoto et al. | 430/108.22 |
| 2003/0027066 | A1 | 2/2003 | Yamashita et al. | |
| 2003/0055159 | A1 | 3/2003 | Yamashita et al. | |
| 2003/0096185 | A1 | 5/2003 | Yamashita et al. | |
| 2003/0138717 | A1 | 7/2003 | Yagi et al. | 430/110.3 |
| 2004/0053154 | A1 | 3/2004 | Tomita et al. | |
| 2004/0131961 | A1 | 7/2004 | Watanabe et al. | |
| 2004/0142265 | A1 | 7/2004 | Tomila et al. | 430/108.4 |
| 2004/0229147 | A1 | 11/2004 | Higuchi et al. | |
| 2005/0112488 | A1 | 5/2005 | Yamada et al. | |
| 2005/0186498 | A1 | 8/2005 | Honda et al. | |
| 2006/0154168 | A1 | 7/2006 | Tomita et al. | |
| 2006/0210903 | A1 | 9/2006 | Ohki et al. | |
| 2006/0240349 | A1 | 10/2006 | Watanabe et al. | |

FOREIGN PATENT DOCUMENTS

| | | |
|---|---|---|
| EP | 1 172 703 A2 | 1/2002 |
| EP | 1 205 813 A1 | 5/2002 |
| EP | 1 243 976 A2 | 9/2002 |
| JP | 01-128071 | 5/1989 |
| JP | 04-353866 | 12/1992 |
| JP | 04-358159 | 12/1992 |
| JP | 04-362953 | 12/1992 |
| JP | 06-059504 | 3/1994 |
| JP | 06-130714 | 5/1994 |
| JP | 11-113665 | 5/1999 |
| JP | 11-149180 | 6/1999 |
| JP | 2000-292981 | 10/2000 |

* cited by examiner

TONER, DEVELOPER INCLUDING THE TONER, CONTAINER CONTAINING THE TONER OR THE DEVELOPER AND METHOD OF PRODUCING THE TONER

This application is a Continuation Application of U.S. Ser. No. 10/724,260 filed Dec. 1, 2003, now allowed.

BACKGROUND OF THE INVENTION

1. Field of the Invention

The present invention relates to a toner, and more particularly to a toner for developing an electrostatic latent image formed on an image bearer such as a photoreceptor to visualize the latent image. The present invention also relates to a developer including the toner and a container including the toner or the developer, and a method of producing the toner.

2. Discussion of the Background

A pressing and heating method with a heating roller in an electrophotographic image forming method passes a toner image on a transfer sheet through a surface of the heating roller having releasability with a toner while contacting the toner image upon application of pressure. The method can quickly fix a toner image on the transfer sheet because the surface of the heating roller contacts the toner image on the transfer sheet upon application of pressure and heat efficiency in fusion bonding of the toner image onto the transfer sheet is quite good. So-called offset phenomena, in which a part of a toner image adheres to a surface of a heating roller because the toner image melts and contacts the surface thereof upon application of pressure and the part of the toner image transfers onto a following transfer sheet and contaminates the sheet, is largely influenced by a fixing speed and temperature. Typically, when the fixing speed is slow, a surface temperature of the heating roller is set comparatively low, and when the fixing speed is fast, the surface temperature thereof is set comparatively high. This is to fix heat quantity imparted from the heating roller to the toner regardless of the fixing speed.

A toner on a transfer sheet has multiple layers, and particularly in an image forming apparatus in which a fixing speed is fast and a surface temperature of the heating roller is high, a temperature difference between a top layer contacting the heat roller and a bottom layer contacting the transfer sheet is large. When the surface temperature of the heating roller is high, the top layer of the toner tends to cause offset phenomena. When the surface temperature of the heating roller is low, phenomena called low-temperature offset tends to occur, in which the bottom layer of the toner does not sufficiently melt and fix on the transfer sheet.

To solve this problem, a method of anchoring a toner on a transfer sheet by increasing the fixing pressure is usually used when the fixing speed is high. This method can decrease the heating roller temperature somewhat and prevent the high-temperature offset phenomena of the top layer of the toner. However, because a shearing force applied to the toner is quite large, the transfer sheet winds the heating roller and a winding offset occurs, and a trance of a separation pick separating the transfer sheet from the heating roller tends to appear on a fixed image. Further, the high pressure crushes a line image and causes toner scattering when fixed, resulting in deterioration of the fixed image quality.

In a high-speed fixing method, a toner having a lower melting viscosity than a toner used in a low-speed fixing method is typically used and a surface temperature and a fixing pressure of the heating roller are decreased to prevent the high-temperature offset and wind offset. However, when such a toner having a low melting viscosity is used in a low-speed fixing method, the high-temperature offset phenomena tend to occur.

As mentioned above, a toner having a good offset resistance and a wide range of fixable temperature, which is applicable in both a high-speed and a low-speed fixing methods, is desired.

On the other hand, a particle size of the toner is being downsized to increase resolution and sharpness of the resultant image. However, fixability of a halftone image formed with a small particle size toner deteriorates. This phenomenon noticeably occurs in high-speed fixing. This is because a toner amount is small on a halftone image, a toner transferred onto a concave portion of a transfer sheet receives less heat amount from a heating roller, and further a fixing pressure deteriorates as a convex portion of the transfer sheet inhibits the pressure to the concave portion thereof. As a toner layer transferred onto a halftone image on the convex portion of the transfer sheet is thin, a shearing force against a toner particle is larger than a shearing force against a toner particle on a black solid image having a thick toner layer. Therefore, the offset phenomena tend to occur and the resultant fixed image tends to be a low quality image.

Japanese Laid-Open Patent Publication No. 1-128071 discloses a toner including a polyester resin as a binder resin and having a specific storage viscosity at 95° C. However, fixability and offset resistance thereof still need to be improved.

Japanese Laid-Open Patent Publication No. 4-353866 discloses a toner having rheologic properties in which a drop starting temperature of a storage modulus is from 100 to 110° C., the toner has a specific storage modulus at 150° C. and a peak temperature of a loss elasticity is 125° C. However, as both the storage modulus and loss elasticity are too small and the peak temperature of the loss elasticity is too high, low-temperature fixability of the resultant toner is not improved and heat resistance thereof is low.

Japanese Laid-Open Patent Publication No. 6-59504 discloses a toner including a specifically structured polyester resin as a binder resin, and having a specific storage modulus at from 70 to 120° C. and a specific loss elasticity at from 130 to 180° C. However, as the storage modulus at from 70 to 120° C. is large and the loss elasticity at from 130 to 180° C. is small, a small particle size magnetic toner is difficult to fix at a low temperature and offset resistance of the toner of the invention is desired to be improved.

When the small particle size magnetic toner includes a large amount of a magnetic material, the fixability problem noticeably occurs. In terms of rheology, an increase of a colorant included in a toner tends to increase the storage modulus and loss elasticity. Therefore, when it is cold, a copy image produced immediately after a copier is switched on occasionally has worse fixability, which is desired to be improved.

Japanese Laid-Open Patent Publication No. 4-358159 discloses a developer including a vinyl polymer and two polyethylene and/or polyethylene waxes having different softening points, one of which is included in polymerizing and the other of which is included in kneading. As the two waxes have a high softening point of 100° C. and a small softening point difference of from 2 to 20° C., the resultant developer has good offset resistance, but poor low-temperature fixability.

Japanese Laid-Open Patent Publication No. 4-362953 discloses a toner including a de-free fatty acid carnauba wax and a rice wax oxide having an acid value of from 10 to 30. The toner has good low-temperature fixability, but low offset and blocking resistance and fluidity.

Japanese Laid-Open Patent Publication No. 6-130714 discloses a toner including a linear polyester as a fixing resin and waxes having a similar softening point to that of the linear polyester and a higher softening point than that thereof. The toner practically has good blocking resistance and offset resistance, but poor low-temperature fixability due to a high melting point of the waxes.

Japanese Laid-Open Patent Publication No. 11-133665 discloses a dry toner including an urethane-modified polyester as a toner binder and having a practical sphericity of from 0.90 to 1.00 for the purpose of improving fluidity, low-temperature fixability and hot offset resistance of the toner. In addition, the toner having a small particle size has good powder fluidity, transferability, thermostable preservability, low-temperature fixability and hot offset resistance. Particularly, when used in a full-color copier, the resultant image has good glossiness and an oil application to a heating roller is not required.

As a method of economically obtaining such a dry toner, Japanese Laid-Open Patent Publications Nos. 11-149180 and 2000-292981 disclose a dry toner and a method of producing the toner including a toner binder which is an elongation and/or a crosslinking reaction product of a prepolymer having an isocyanate group and a colorant, wherein the dry toner is a particulate material formed by an elongation and/or a crosslinking reaction of the prepolymer by amines in a water medium.

However, although a process using a urea reaction to prepare a binder in Japanese Laid-Open Patent Publication No. 11-133665 turns a new feature and an effect, the process is a pulverizing process and the resultant toner does not have sufficient low-temperature fixability. Specific conditions of controlling shapes of a small particle size and a sphere are not disclosed therein. In Japanese Laid-Open Patent Publications Nos. 11-149180 and 2000-292981, a toner is formed by granulation in water, wherein pigments in an oil phase agglutinate in a water phase interface, and a volume resistance thereof lowers and non-uniform dispersion thereof cause basic performance problems of the toner. An effect of the invention is not exerted without a targeted shape and properties to achieve oilless, small particle size and to be used in an apparatus. As the targeted shape and properties are not mentioned in respective publications, an effect of the invention is difficult to exert against problems. Particularly, pigments and waxes tend to gather on a surface of a toner formed by granulation in water, and when a particle size thereof is not greater than 6 μm, a specific surface area thereof becomes large. Therefore, a surface design of the particle is essential to obtain desired chargeability and fixability.

Because of these reasons, a need exists for a toner having good releasability, offset resistance, blocking resistance and fluidity as well as fixability.

SUMMARY OF THE INVENTION

Accordingly, an object of the present invention is to provide a toner capable of fixing well immediately after an electrophotographic image forming apparatus including the toner is switched on and at a low electric power, and which has good releasability, offset resistance, blocking resistance and fluidity as well in low and high speed electrophotographic image forming apparatuses.

Another object of the present invention is to provide a two-component developer including the toner and a carrier, and a toner container containing the toner or two-component developer.

Briefly these objects and other objects of the present invention as hereinafter will become more readily apparent can be attained by a toner including toner particles including: a first binder resin; a second binder resin having a glass transition temperature of from 40 to 55° C.; a colorant; and a release agent, and a particulate resin material which is located on surface of the toner particles with a coverage of from 50 to 100%, and which has a glass transition temperature of from 50 to 90° C., wherein a weight ratio (W2/W1) between the second binder resin (W2) and the first binder resin (W1) is from 5/95 to 40/60, and wherein a ratio (G'80/G'180) between a storage modulus of the toner at 80° C. (G'80) and a storage modulus at 180° C. (G'180) is from 100 to 1,000.

The G'80 and G'180 are preferably from $1\times10^5$ to $5\times10^7$ (Pa) and $5\times10^2$ to $3\times10^3$ (Pa) respectively.

The first binder resin and second binder resin preferably include a polyester resin and a modified polyester resin as a main component respectively.

In an aspect of the present invention, the first binder resin has an acid value of from 1 to 30 mg KOH/g.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Generally, the present invention provides a toner capable of fixing well immediately after an electrophotographic image forming apparatus including the toner is switched on and at a low electric power, and which has good releasability, offset resistance, blocking resistance and fluidity as well in low and high speed electrophotographic image forming apparatuses.

The present inventors discovered that a toner including a particulate resin material having a glass transition temperature of from 50 to 90° C. and a toner surface coverage of from 50 to 100% on a surface thereof; a first binder resin; a second binder resin having a glass transition temperature of from 40 to 55° C.; a colorant; and a release agent, wherein a weight ratio (W2/W1) between the second binder resin (W2) and the first binder resin (W1) is from 5/95 to 40/60, and wherein a ratio (G'80/G'180) between a storage modulus of the toner at 80° C. (G'80) and a storage modulus at 180° C. (G'180) is from 100 to 1,000 has good low-temperature fixability, releasability, a small particle diameter and well dispersed pigments to produce high quality images, and good blocking resistance conflicting the low-temperature fixability when stored. The storage modulus at 80° C. (G'80) and at 180° C. (G'180) are preferably from $1\times10^5$ to $5\times10^7$ (Pa) and $5\times10^2$ to $3\times10^3$ (Pa) respectively. Particularly to further improve the low-temperature fixability, G'80 and G'180 are more preferably from $1\times10^5$ to $5\times10^6$ (Pa) and $5\times10^2$ to $3\times10^3$ (Pa) respectively.

Figure 1:
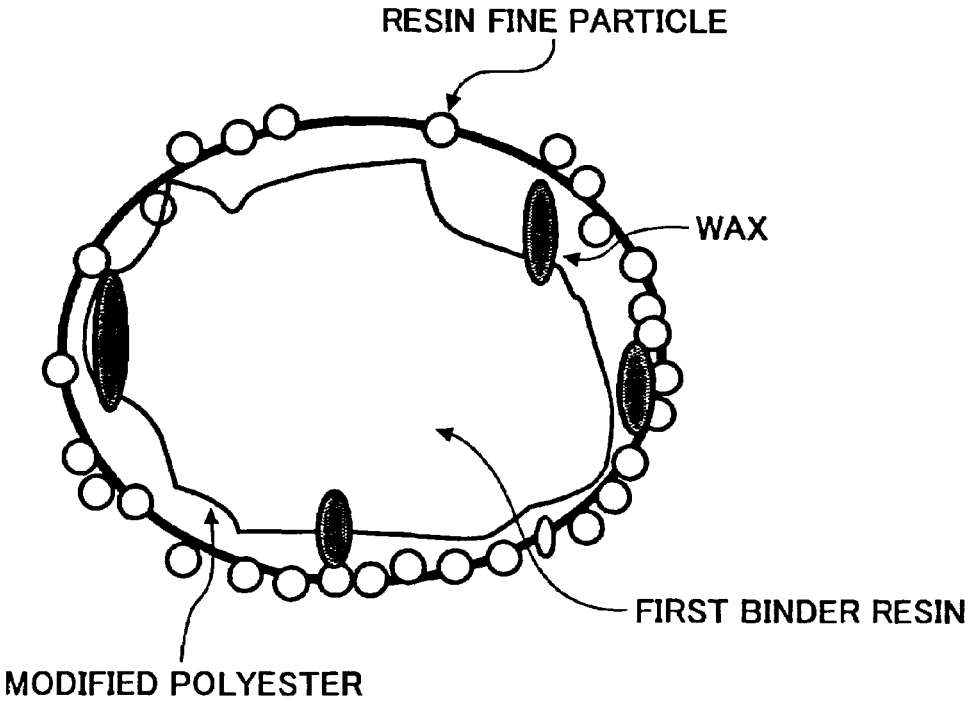
FIG. 1 is a schematic view illustrating a toner particle of the present invention.

FIG. 1 is a schematic view illustrating a toner particle of the present invention.

A toner having a ratio (G'80/G'180) between a storage modulus at 80° C. (G'80) and a storage modulus at 180° C. (G'180) of from 100 to 1,000 has good low-temperature fixability, releasability, a small particle diameter and well dispersed pigments to produce high quality images. This is because the toner starts to being softened to have a fixable elasticity level at 80° C., and does not flow and maintains the elasticity at 180° C. to achieve hot offset resistance.

Conventionally, to achieve low-temperature fixability, elasticity of a toner at from 80 to 100° C. has been lowered. However, when the elasticity lowers at around 180° C., wider releasability cannot be obtained. Particularly, the low-temperature fixability can be obtained by lowering the elasticity at 80° C. while maintaining the elasticity at 180° C. It is difficult to form a toner particle having a ratio (G'80/G'180) between a storage modulus at 80° C. (G'80) and a storage modulus at 180° C. (G'180) less than 100, and the low-temperature fixability cannot be obtained when the ratio is greater than 1,000.

A wide elasticity depends on glass transition temperatures (Tg) of the first binder resin and second binder resin, their particle compositions and Tg of the particulate resin material. When the first binder resin having a low Tg and is present in a toner particle, and the second binder resin and the particulate resin material are present close to a surface thereof, the toner has a viscoelasticity curve due to the inner low-elasticity binder and surface thin elastic layer. This pseudo capsule structure performs the low-temperature fixability and prevents blocking when stored.

A method of measuring the viscoelasticity will be explained.

A toner sample having a diameter 20 mm and a thickness of 2 mm is fixed on a parallel plate and the viscoelasticity thereof is measured by RheoStress RS50 from HAAKE at a frequency 1 Hz, a temperature of from 80 to 210° C., a distortion of 0.1 and a programming speed of 3° C./min.

A method of producing a toner of the present invention, which comprises: dissolving or dispersing a toner composition comprising a first binder resin and a second binder resin comprising a modified polyester resin in an organic solvent to prepare a solution or a dispersion; mixing the solution or the dispersion with a compound having an active hydrogen atom in an aqueous medium comprising the particulate resin material to react the modified polyester with the compound to prepare a reactant; removing the organic solvent from the reactant to prepare the toner particles; and washing the toner particles to remove excessive particles of the particulate resin material from a surface thereof.

The toner of the present invention is a toner formed by dissolving or dispersing at least a modified polyester resin capable of reacting with a compound having an active hydrogen atom, a colorant and a release agent in an organic solvent; dispersing the dissolved or dispersed solution in a water medium in the presence of a particulate polymer; subjecting the dispersed material to a polyaddition reaction with a reaction material formed of amines; and removing the solvent from the dispersed material. The toner is characterized by having a volume-average particle diameter (Dv) of from 4.0 to 7.0 μm. Particularly, the toner having a small particle diameter is advantageous to the low-temperature fixability and hot offset resistance.

This is because it is considered that heat conductance of the toner particle and spreadability thereof at surface concave and convex portions of a paper are improved, and a release agent tends to be present close to a surface of the toner having a small particle diameter to exert an effect on the hot offset resistance.

A dry toner having such particle structure can have low-temperature fixability and a wide release width in roller and belt fixations.

It is supposed that a toner fixation on a transfer sheet in the roller and belt fixation in recent energy-saving copiers, printers and facsimiles practically stars at from about 70 to 100° C. As the toner needs to start flowing at around this temperature to melt, the first binder starts to melt. At this time, the toner melting status can quantitatively be known by measuring the storage modulus thereof at 80° C. The fist binder resin having a TG of from 45 to 55° C. can achieve the temperature of from 70 to 100 ° C. However, as the fist binder resin having a TG of from 45 to 55° C. cannot achieve blocking resistance and thermostable preservability at from 40 to 50° C., it is advantageous to form a binder resin close to a surface of the toner with the second binder resin which is polymerized by a urea bond formed by a reaction between a prepolymer and amines, and which has a surface partially network-structured and a stress resistant three-dimensional structure.

However, when the second binder is thickly present or is hard, a binder resin and a wax are difficult to filter from an in side of the toner particle, and therefore a weight ratio between the second binder resin and the first binder resins preferably from 5/95 to 40/60.

The toner surface of the present invention is coated with a particulate resin material having a glass transition temperature of from 50 to 90° C. at a coverage of from 50 to 100% so as to be easily charged. The particulate resin material is preferably present in an amount of not less than 5% by weight, and more preferably from 0.1 to 3% by weight in the toner such that the first binder resin and the wax sufficiently filter in low-temperature fixation. Thus, the first binder resin and wax sufficiently filter from an inside of the toner by a pressure and a heat of a fixing roller.

A wax is dispersed in a toner composition to achieve oilless, and in the toner production method of the present invention, a toner composition including a wax is first dispersed by a beads mill to uniformly disperse the wax in the toner. Therefore, the wax is less exposed on a pulverized interface than a pulverized toner and is not included in a toner as is in a suspension polymerized toner, and which is a preferable structure to obtain low-temperature fixability and fluidity of a toner. A wax for use in the present invention preferably has a melting point of from 60 to 120° C. A polyester resin is most effectively used as the first binder resin for low-temperature fixability.

When the first unmodified binder resin has a Tg less than 40° C., the toner has a weak inside cohesive force and is easily deformed, and therefore the toner does not have preservability. When the Tg is over 55° C., low-temperature fixability of the resultant toner deteriorates. When the ratio between the second binder resin and first binder resin is not greater than 5/95, a film formation on a surface of the resultant toner is insufficient and a binder resin having a low Tg filters from an inside of the toner to cause frequent blocking of the toner. The toner of the present invention preferably has a volume-average particle diameter (Dv) of from 4 to 7 μm.

Typically, it is said that the smaller the toner particle diameter, the more advantageous to produce high resolution and quality images. However, the small particle diameter of the toner is disadvantageous thereto to have transferability and cleanability. When the volume-average particle diameter is smaller than 4 μm, the resultant toner in a two-component developer melts and adheres to a surface of a carrier to deteriorate chargeability thereof when stirred for a long time in an image developer. When the toner is used in a one-component developer, toner filming over a developing roller and fusion bond of the toner to a blade forming a thin layer thereof tend to occur.

These phenomena also occur when a toner having a larger content of the particulate resin material than the content mentioned above.

When the volume-average particle diameter is larger than 7 μm, the resultant toner has a difficulty in producing high resolution and quality images. In addition, the resultant toner has a large variation of the particle diameters in many cases when the toner in a developer is fed and consumed. When the volume-average particle diameter/a number-average particle diameter is greater than 1.40, the similar phenomena occur.

When the volume-average particle diameter/number-average particle diameter is preferably close to 1.00 in terms of movement uniformity and stability of the resultant toner, and uniformity of charged amount thereof.

A ratio (Dv/Dn) between the volume-average particle diameter and number-average particle diameter (Dn) is preferably not greater than 1.40, and more preferably from 1.00 to 1.20. The toner of the present invention in a two-component developer has less particle diameter variation even when the toner is fed and consumed for a long time, and has good and stable developability even when stirred for a long time in an image developer. When the toner is used as a one-component developer, the toner has less particle diameter variation even when the toner is fed and consumed, no filming over a developing roller and no fusion bond to a blade forming a thin layer of the toner. In addition, the toner has good and stable developability even when stirred for a long time in an image developer.

It is essential that the particulate resin material for use in the present invention, which is omnipresent on a surface of the toner, has a glass transition temperature (Tg) of from 50 to 90° C. and a coverage over a toner particle of from 50 to 100%. When the coverage is less than 50%, the first binder resin has a low Tg and thermostable preservability of the resultant toner tends to deteriorate. When the glass transition temperature (Tg) is less than 50° C., preservability of the resultant toner deteriorates and blocking thereof occurs when stored and in an image developer. When the glass transition temperature (Tg) is greater than 90° C., the particulate resin material prevents the resultant toner from adhering to a transfer sheet and the minimum fixable temperature increases. Therefore, as the toner does not have a sufficient fixable temperature width, it cannot be used in a copier having a low-temperature fixing system and a fixed image there by peels off. The glass transition temperature (Tg) is more preferably from 50 to 70° C.

The particulate resin material preferably has a volume-average molecular weight of from 1,000 to 100,000.

The particulate resin material preferably has a weight-average molecular weight not greater than 100,000, and more preferably not greater than 50,000. A minimum molecular weight thereof is typically 4,000. When the weight-average molecular weight is greater than 100,000, the particulate resin material prevents the resultant toner from adhering to a transfer sheet and the minimum fixable temperature increases.

Any thermoplastic and thermosetting resins capable of forming an aqueous dispersion can be used as the particulate resin material. Specific examples of the resins include vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These can be used alone or in combination. Among these resins, the vinyl resins, polyurethane resins, epoxy resin, polyester resins or combinations of these resins are preferably used because an aqueous dispersion of a fine-spherical particulate resin material can easily be obtained.

Specific examples of the vinyl resins include single-polymerized or copolymerized vinyl monomers such as styrene-ester(metha)acrylate resins, styrene-butadiene copolymers, (metha)acrylic acid-esteracrylate polymers, styrene-acrylonitrile copolymers, styrene-maleic acid anhydride copolymers and styrene-(metha)acrylic acid copolymers.

The particulate resin material preferably has an average particle diameter of from 5 to 200 nm, and more preferably from 20 to 300 nm.

The particulate resin material on the toner of the present invention is added thereto in a production process thereof to control the toner formation such as a circularity and a particle diameter distribution thereof. The particulate resin material of the present invention improves friction chargeability of the resultant toner. When the particulate resin material coverage is less than 50%, a sufficient friction chargeability cannot be imparted to the toner, resulting in insufficient image density and background fouling of images produced thereby.

The particulate resin material coverage is measured by an image analyzer analyzing a picture photographed by using an electron microscope. The measuring conditions will be explained later.

The toner of the present invention preferably has a specific shape and a distribution thereof. When a toner having a low average circularity less than 0.94 and an amorphous shape too apart from a sphere cannot produce high quality images having a satisfactory transferability and no toner scattering. An optical (detection) method is used to measure a shape, in which a suspension liquid including a particulate material is passed through a flat plate imaging (detector) and the particulate material image is optically detected by a CCD camera to analyse the image. A peripheral length of a circle having an area equivalent to that of a projected image obtained by the method is divided by an actual peripheral length of the particulate material to determine an average circularity. A toner having the average circularity of from 0.940 to 1.000 has a proper density reproducibility and produces highly fine images. A toner preferably has an average circularity of from 0.940 to 0.960, and more preferably from 0.945 to 0.955 and 10% or less of particles having a circularity less than 0.940. When the average circularity is greater than 0.960, poor cleaning on a photoreceptor and a transfer belt in a system using a blade cleaning occurs, and which occasionally causes stains on images. A development and a transfer of an image having a low image area rate leaves a small amount of a residual toner after transferred and does not have a problem of poor cleaning. However, the residual toner after transferred increases in a development and a transfer of an image having a high image area rate, and causes background fouling of the resultant images when accumulated. In addition, the residual toner contaminates a charging roller contacting a photoreceptor to charge the photoreceptor and deteriorates the original chargeability of the charging roller. The average circularity is measured by a flow type particle image analyzer FPIA-2100 from Toa Medical Electronics Co., Ltd. A specific measuring method will be explained later.

The toner for use in the present invention preferably has the shape of a spindle.

A toner having an amorphous shape or a flat shape has a poor powder fluidity and the following problems. Background fouling tends to occur because the toner cannot smoothly be charged by friction. The toner has a poor dot reproducibility for a fine latent image dot because of having difficulty in being finely and uniformly arranged. The toner in an electrostatic transfer method has poor transferability because of having difficulty in being affected by an electric power line.

When a toner is close to a true sphere, as powder fluidity thereof is so good that the toner excessively reacts against an external force, toner particles tend to scatter outside a dot in development and transfer. As a spherical toner is easy to roll on a photoreceptor and rolls into a space between the photoreceptor and a cleaning member to cause poor cleaning in many cases.

As powder fluidity of the spindle-shaped toner of the present invention is properly controlled, the toner is smoothly charged by friction, does not cause background fouling, develops a fine latent dot in order and is efficiently transferred afterwards. Further, the powder fluidity properly prevents the toner from scattering. As the spindle-shaped toner has limited rolling axes, the toner is difficult to roll in to the space between the photoreceptor and a cleaning member to cause poor cleaning.

Figure 2A:
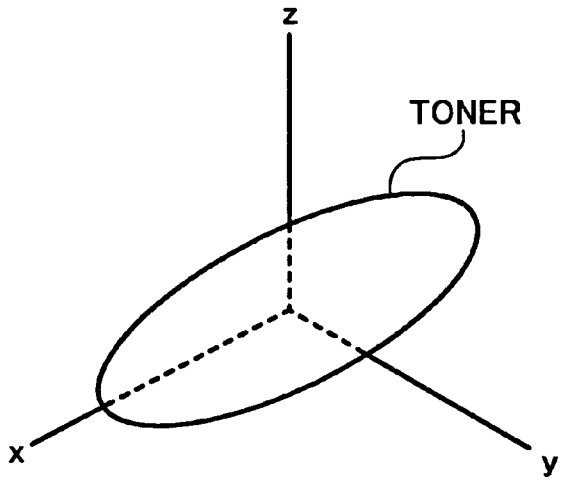
FIGS. 2A to 2C are graphics for explaining a spindle-shaped toner of the present invention.
Figure 2B:
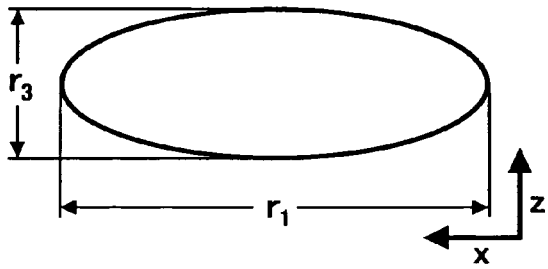
Figure 2C:
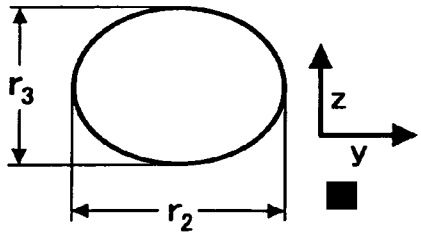

The spindle-shaped toner of the present invention preferably has the shape of a spindle having a ratio ($r_2/r_1$) between a major axis ($r_1$) and a minor axis ($r_2$) of from 0.5 to 0.8, and a ratio ($r_3/r_2$) between a thickness ($r_3$) and the minor axis ($r_2$) of from 0.7 to 1.0 as shown in FIGS. 2A o 2C.

When the ratio ($r_2/r_1$) between a major axis ($r_1$) and a minor axis ($r_2$) is less than 0.5, the resultant toner which is away from the shape of a true sphere has high cleanability, but poor dot reproducibility and transferability.

When the ratio ($r_2/r_1$) between a major axis ($r_1$) and a minor axis ($r_2$) is greater than 0.8, the resultant toner which is close to a sphere occasionally particularly has poor cleanability in a low temperature and humidity environment. When the ratio ($r_3/r_2$) between a thickness ($r_3$) and the minor axis ($r_2$) is less than 0.7, the resultant toner which is close to a flat shape does not scatter so much as an amorphous toner, but does not have so high a transferability as a spherical toner does. When the ratio ($r_3/r_2$) between a thickness ($r_3$) and the minor axis ($r_2$) is 1.0, the resultant toner becomes a rotating body having the major axis as a rotating axis. The shape of a spindle of the toner of the present invention, which is neither an amorphous/flat shape nor a true sphere, is a shape satisfying all friction chargeability, dot reproducibility, transferability, scattering resistance and cleanability the both shapes have.

The $r_1$, $r_2$ and $r_3$ are measured by observing the toner with a scanning electron microscope (SEM) and photographing the toner while changing a view angle.

Conventional materials can be used as the first unmodified binder resin. Specific examples of the binder resins conventionally used for producing a toner include polyester resins, styrene resins, acrylic resins, epoxy resins, etc. Among these resins, resins formed from styrene and ester acrylate copolymers are typically used for a conventional toner. Resins satisfying the above-mentioned thermal properties are used for a low-temperature fixable toner. When the polyester resin having a low softening point and a high glass transition temperature is used as a binder resin, the resultant toner has good low-temperature fixability and storage stability. Further, an ester bond of the polyester resin has a good affinity with a paper, the resultant toner also has a good offset resistance.

The polyester resin used as a main component for a binder resin for the toner of the present invention is formed by a condensation reaction between an acid constituent and an alcohol constituent, a ring-opening reaction of a cyclic ester or a reaction among a halogenated compound, an alcohol constituent and carbon oxide. Polymerizing monomers which are materials for synthesizing a polyester resin in the above-mentioned liquid solution of a polymer compound easily forms the toner of the present invention having good properties. Hereinafter, various monomers used as materials for synthesizing the polyester resin will be explained.

First, alcohol and acids having 2 valences or more are preferably used. Specific examples of the bivalent alcohol include diol such as ethylene glycol, diethylene glycol, triethylene glycol, 1,2-propylene glycol, 1,3-propylene glycol, 1,4-butadieneol, neo-pentyl glycol, 1,4-butenediol, 1,5-pentanediol and 1,6-hexanediol; and adducts of a bisphenol A such as bisphenol A, hydrogenated bisphenol A, α,α'-bis(4-hydroxyphenyl)1,4-diisopropylbenzene, polyoxyethylene modified bisphenol A and polyoxyproplylene modified bisphenol A with an alkylene oxide.

Specific examples of the alcohol having 3 valences or more include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene, etc.

Specific examples of the bivalent acids include maleic acids, fumaric acids, citraconic acids, itaconic acids, glutaconic acids, phthalic acids, isophthalic acids, terephthalic acids, cyclohexane dicarboxylic acids, succinic acids, adipic acids, sebacic acids, azelaic acids, malonic acids and other bivalent organic acids. Specific examples of the trivalent acids include 1,2,4-benzenetricarboxylic acids, 2,5,7-naphthalenetricarboxylic acids, 1,2,4-naphthalenetricarboxylic acids, 1,2,4-butanetricarboxylic acids, 1,2,5-hexanetricarboxylic acids, 1,3-dicarboxyl-2-methyl-methylenecarboxypropane, tetra(methylenecarboxyl)methane, 1,2,7,8-octantetracarboxylic acids, etc. Anhydrides and halides of these organic acids are also preferably used.

Specific examples of other compounds equivalent to the acid constituents include halides such as cis-1,2-dichloroethene, trans-1,2-dichloroethene, 1,2-dichloropropene, 2,3-dichloropropene, 1,3-dichloropropene, o-dichlorobenzene, m-dichlorobenzene, p-dichlorobenzene, o-dibromobenzene, m-dibromobenzene, p-dibromobenzene, o-chlorobromobenzene, dichlorocyclohexane, dichloroethane, 1,4-dichlorobutane, 1,8-dichlorooctane, 1,7-dichlorooctane, dichloromethane, 4,4'-dibromovinylphenol and 1,2,4-tribromobenzene.

In the present invention, either of the above-mentioned acids or alcohol preferably has at least an aromatic ring.

As for a ratio of an amount consumed between the acid and alcohol, an alcohol group preferably has 0.9 to 1.5 mol equivalent weight, and more preferably 1.0 to 1.3 mol equivalent weight per 1 mol equivalent weight of a carboxyl group. The carboxyl group also includes the above-mentioned halides which are compounds equivalent to the acid constituents. Amines can be used as other additives. Specific examples thereof include triethylamine, trimethylamine, N,N-dimethylaniline, etc. Other condensing agents such as dicyclohexylcarbodiimide may also be used.

The modified polyester resin capable of reacting with a compound having an active hydrogen atom (RMPE) include a polyester prepolymer having a functional group reacting with an active hydrogen atom such as an isocyanate group. Hereinafter, the polyester resin is referred to as polyester.

A polyester prepolymer having an isocyanate group (A) is preferably used in the present invention. The prepolymer (A) is formed from a reaction between polyester having an active hydrogen atom formed by polycondensation between polyol (PO) and a polycarboxylic acid (PC), and polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol (PO), diol (DIO) and polyol having 3 valences or more (TO) can be used, and DIO alone or a mixture of DIO and a small amount of TO is preferably used. Specific examples of DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used.

Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (PC), dicarboxylic acid (DIC) and polycarboxylic acid having 3 or more valences (TC) can be used. DIC alone, or a mixture of DIC and a small amount of TC are preferably used.

Specific examples of DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylicacid. In particular, alkenylene dicarboxylic acid having 4 to 20 carbon atoms and aromatic dicarboxylic acid having 8 to 20 carbon atoms are preferably used.

Specific examples of TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

The content of the constitutional component of a polyisocyanate in the polyester prepolymer (A) having a polyisocyanate group at its end portion is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

When the above-mentioned polyester prepolymer having an isocyanate group is reacted with amines (B), a urea-modified polyester resin (UMPE) can be obtained. The urea-modified polyester resin (UMPE) is effectively used as a toner binder.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorondiamine); aliphatic diamines (e.g., ethylene diamine, tetramethylene diamine and hexamethylene diamine); etc.

Specific examples of the polyamines (B2) having three or more amino groups include diethylene triamine, triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc.

Among these amines (B), diamines (B1) and mixtures in which a diamine is mixed with a small amount of a polyamine (B2) are preferably used.

The molecular weight of the urea-modified polyesters can optionally be controlled using an elongation anticatalyst, if desired. Specific examples of the elongation anticatalyst include monoamines such as diethyle amine, dibutyl amine, butyl amine and lauryl amine, and blocked amines, i.e., ketimine compounds prepared by blocking the monoamines mentioned above.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

The urea-modified polyester (UMPE) of the present invention may include an urethane bonding as well as a urea bonding. The amines (B) act as a compound having an active hydrogen atom the modified polyester is capable of reacting with.

The UMPE of the present invention can be produced by a method such as a one-shot method. The weight-average molecular weight of the modified polyester of the UMPE is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the modified polyester of the UMPE is not particularly limited when the after-mentioned unmodified polyester resin (PE) is used in combination. Namely, the weight-average molecular weight of the UMPE resins has priority over the number-average molecular weight thereof. However, when the UMPE is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

Specific examples of the colorants for use in the present invention include any known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, IndanthreneBlue (RS and BC), Indigo, ultramarine, Prussian blue, Anthraquinone Blue, Fast Violet B, Methyl Violet Lake, cobalt violet, manganese violet, dioxane violet, Anthraquinone violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1 to 15% by weight, and more preferably from 3 to 10% by weight, based on total weight of the toner.

The colorant for use in the present invention can be used as a master batch pigment when combined with a resin.

Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three roll mill is preferably used for kneading the mixture upon application of high shear stress.

The toner of the present invention may include a wax together with a toner binder and a colorant. Specific examples of the wax include known waxes, e.g., polyolefin waxes such as polyethylene wax and polypropylene wax;

long chain carbon hydrides such as paraffin wax and sasol wax; and waxes including carbonyl groups. Among these waxes, the waxes including carbonyl groups are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner.

A content of the wax in a toner is preferably from 0 to 40% by weight, and more preferably from 3 to 30% by weight.

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

These charge controlling agent can be dissolved and dispersed after kneaded upon application of heat together with a master batch pigment and resin, can be added when directly dissolved and dispersed in an organic solvent or can be fixed on a toner surface after the toner particles are produced.

As an external additive for improving fluidity, developability and chargeability of the colored particles of the present invention, inorganic particulates are preferably used. The inorganic particulates preferably have a primary particle diameter of from 2 nm to 2 μm, and more preferably from 20 nm to 500 nm. In addition, a specific surface area of the inorganic particulates measured by a BET method is preferably from 20 to 500 $m^2/g$. The content of the external additive is preferably from 0.01 to 5% by weight, and more preferably from 0.01 to 2.0% by weight, based on total weight of the toner.

Specific examples of the inorganic particulates include silica, alumina, titanium oxide, barium titanate, magnesium titanate, calcium titanate, strontium titanate, zinc oxide, tin oxide, quartzsand, clay, mica, sand-lime, diatom earth, chromium oxide, ceriumoxide, redironoxide, antimony trioxide, magnesium oxide, zirconium oxide, barium sulfate, barium carbonate, calcium carbonate, silicon carbide, silicon nitride, etc.

Other than these materials, polymer particulates such as polystyrene formed by a soap-free emulsifying polymerization, a suspension polymerization or a dispersing polymerization, estermethacrylate or esteracrylate copolymers, silicone resins, benzoguanamine resins, polycondensation particulates such as nylon and polymer particles of thermosetting resins can be used.

These external additives, i.e., surface treatment agents can increase hydrophobicity and prevent deterioration of fluidity and chargeability of the resultant toner even in high humidity. Specific examples of the surface treatment agents include silane coupling agents, sililating agents, silane coupling agents having an alkyl fluoride group, organic titanate coupling agents, aluminium coupling agents silicone oils and modified silicone oils.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particulates prepared by a soap-free emulsifying polymerization method such as polymethylmethacrylate particulates and polystyrene particulates. The polymer particulates comparatively have a narrow particle diameter distribution and preferably have a volume-average particle diameter of from 0.01 to 1 μm.

The toner binder of the present invention can be prepared, for example, by the following method. Polyol and polycarboxylic acid are heated to a temperature of from 150 to 280° C. in the presence of a known catalyst such as tetrabutoxy titanate and dibutyltinoxide. Then water generated is removed, under a reduced pressure if desired, to prepare a polyester resin having a hydroxyl group. Then the polyester resin is reacted with polyisocyanate at a temperature of from 40 to 140° C. to prepare a prepolymer (A) having an isocyanate group. Further, the prepolymer (A) is reacted with an amine (B) at a temperature of from 0 to 140° C., to prepare a urea-modified polyester.

When polyisocyanate, and A and B are reacted, a solvent can be used if desired. Suitable solvents include solvents which do not react with polyisocyanate. Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran. When polyester which does not have a urea bonding is used in combination with the urea-modified polyester, a method similar to a method for preparing a polyester resin having a hydroxyl group is used to prepare the polyester which does not have a urea bonding, and the polyester which does not have a urea bonding is dissolved and mixed in a solution after a reaction of the urea-modified polyester is completed.

The toner of the present invention is produced by the following method, but the method is not limited thereto.

An aqueous medium for use in the present invention include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner of the present invention can be prepared by reacting a dispersion formed of the prepolymer (A) having an isocyanate group with (B). As a method of stably preparing a dispersion formed of the urea-modified polyester or the prepolymer (A) in an aqueous medium, a method of including toner constituents such as the urea-modified polyester or the prepolymer (A) into an aqueous medium and dispersing them upon application of shear stress is preferably used.

A prepolymer (A) and other toner constituents such as colorants, master batch pigments, release agents, charge controlling agents, unmodified polyester resins, etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method of dyeing particles previously formed without a colorant by a known dying method can also be used.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, the urea-modified polyester (i) or prepolymer (A) can easily be dispersed because the dispersion formed thereof has a low viscosity.

A content of the aqueous medium to 100 parts by weight of the toner constituents including the urea-modified polyester or prepolymer (A) is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have a desired particle diameter. In contrast, when the content is greater than 2,000, the production cost increases. A dispersant can preferably be used to prepare a stably dispersed dispersion including particles having a sharp particle diameter distribution.

To synthesize the urea-modified polyester from the prepolymer (A), the amines (B) may be added to the toner constituents before dispersed in an aqueous medium or after dispersed. In this case, the urea-modified polyester is formed on a surface of the toner by priority and a concentration gradient can be formed in particles.

Specific examples of the dispersants used to emulsify and disperse an oil phase for a liquid including water in which the toner constituents are dispersed include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants having a fluoroalkyl group include SURFLON S-111, S-112and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite which are hardly insoluble in water can also be used.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle. However, the dispersant is preferably washed and removed after the elongation and/or crosslinking reaction of the prepolymer with amine.

Further, in order to decrease viscosity of a dispersion medium including the toner constituents, a solvent which can dissolve the urea-modified polyester or prepolymer (A) can be used because the resultant particles have a sharp particle diameter distribution. The solvent is preferably volatile and has a boiling point lower than 100° C. because of easily removed from the dispersion after the particles are formed. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom under a normal or reduced pressure after the particles are subjected to an elongation reaction and/or a crosslinking reaction of the prepolymer with amine.

When amines (B) as the compounds having an active hydrogen atom is reacted with the modified polyester capable of reacting with the compounds having an active hydrogen atom, the elongation and/or crosslinking reaction time depend on reactivity of an isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from an emulsified dispersion, a method of gradually raising a temperature of the whole dispersion to completely remove the organic solvent in the droplet by vaporizing can be used. Otherwise, a method of spraying the emulsified dispersion in a dry air, completely removing a water-insoluble organic solvent in the droplet to form toner particulates and removing a water dispersant by vaporizing can also be used. As the dry air, an atmospheric air, a nitrogen gas, carbon dioxide gas, a gaseous body in which a combustion gas is heated, and particularly various aerial currents heated to have a temperature not less than a boiling point of a solvent used are typically used. A spray dryer, a belt dryer and a rotary kiln can sufficiently remove the organic solvent in a short time.

When an emulsified dispersion is washed and dried while maintaining a wide particle diameter distribution thereof, the dispersion can be classified to have a desired particle diameter distribution.

A cyclone, a decanter, a centrifugal separation, etc. can remove particulates in a dispersion liquid. A powder after the dispersion liquid is dried can be classified, but the liquid is preferably classified in terms of efficiency. Unnecessary fine and coarse particles can be recycled to a kneading process to form particles. The fine and coarse particles may be wet when recycled.

A dispersant is preferably removed from a dispersion liquid, and preferably removed and classified at the same time.

Heterogeneous particles such as release agent particulates, charge controlling particulates, fluidizing particulates and colorant particulates can be mixed with a toner powder after dried. Release of the heterogeneous particles from composite particles can be prevented by giving a mechanical stress to a mixed powder to fix and fuse them on a surface of the composite particles.

Specific methods include a method of applying an impact strength on a mixture with a blade rotating at a high-speed, a method of putting a mixture in a high-speed stream and accelerating the mixture such that particles thereof collide each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

The toner of the present invention can be used for a two-component developer in which the toner is mixed with a magnetic carrier. A content of the toner is preferably from 1 to 10 parts by weight per 100 parts by weight of the carrier.

Suitable carriers for use in the two component developer include known carrier materials such as iron powders, ferrite powders, magnetite powders, magnetic resin carriers, which have a particle diameter of from about 20 to about 200 μm. A surface of the carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or non-magnetic developer without a carrier.

The container of the present invention contains the toner of the present invention, or the toner and a carrier.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Production Example 1

752 parts of water, 11 parts of a sodium salt of an adduct of a sulfuric ester with ethyleneoxide methacrylate (ELEMINOL RS-30 from Sanyo Chemical Industries, Ltd.), 91 parts of styrene, 81 parts of methacrylate, 100 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 85° C. and reacted for 6 hrs. Further, 30 parts of an aqueous solution of persulfate ammonium having a concentration of 1% were added thereto and the mixture was reacted for 5 hrs at 85° C. to prepare an aqueous dispersion [a particulate dispersion liquid 1] of a vinyl resin (a copolymer of a sodium salt of an adduct of styrene-methacrylate-butylacrylate-sulfuric ester with ethyleneoxide methacrylate). The particulate dispersion liquid 1 was measured by LA-920 to find a volume-average particle diameter thereof was 0.10 μm. A part of the particulate dispersion liquid 1 was dried to isolate a resin component therefrom. The resin component had a Tg of 64° C.

Production Example 2

1.050 parts of water, 80 parts of the particulate dispersion liquid 1, 40 parts of an aqueous solution of sodium dodecyldiphenyletherdisulfonate having a concentration of 48.5% (ELEMINOL MON-7 from Sanyo Chemical Industries, Ltd.) and 95 parts of ethyl acetate were mixed and stirred to prepare a lacteous liquid [an aqueous phase 1].

Production Example 3

220 parts of an adduct of bisphenol A with 2 moles of ethyleneoxide, 561 parts of an adduct of bisphenol A with 3 moles of propyleneoxide, 218 parts terephthalic acid and 2 parts of dibutyltinoxide were mixed and reacted in a reactor vessel including a cooling pipe, a stirrer and a nitrogen inlet pipe for 8 hrs at a normal pressure and 210° C. Further, after the mixture was depressurized by 20 to 65 mm Hg and reacted for 5 hrs, 45 parts of phthalic acid anhydride were added thereto and reacted for 2 hrs at 180° C. and a normal pressure to prepare low-molecular-weight polyester 1. The low-molecular-weight polyester 1 had a number-average molecular weight of 2,200, a weight-average molecular weight of 7,700, a Tg of 43° C. and an acid value of 25.

Production Example 4

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 130° C. Further, after the mixture was depressurized by 10 to 15 mm Hg and reacted for 5 hrs to prepare an intermediate polyester 1. The intermediate polyester 1 had a number-average molecular weight of 2,100, a weight-average molecular weight of 10,500, a Tg of 57° C. and an acid value of 0.5 and a hydroxyl value of 49.

Next, 411 parts of the intermediate polyester 1, 89 parts of isophoronediisocyanate and 500 parts of ethyl acetate were reacted in a reactor vessel including a cooling pipe, a stirrer and a nitrogen inlet pipe for 5 hrs at 100° C. to prepare a prepolymer 1. The prepolymer 1 includes a free isocyanate in an amount of 1.43% by weight.

Production Example 5

170 parts of isophorondiamine and 75 parts of methyl ethyl ketone were reacted at 50° C. for 5 hrs in a reaction vessel including a stirrer and a thermometer to prepare a ketimine compound 1. The ketimine compound 1 had an amine value of 418.

Production Example 6

40 parts of carbon black Mogal L from Cabot Corporation, 60 parts of the low-molecular-weight polyester 1 and 30 parts of water were pre-dispersed to prepare a mixture which is a water-logged pigment aggregate. The mixture was kneaded by a two-roll mil having a surface temperature of 110° C. for 45 min and pulverized to prepare a master batch 1 having a diameter of 1 mm.

Production Example 7

378 parts of the low-molecular-weight polyester 1, 110 parts of rice wax, 22 parts of charge controlling agent (salicylic acid metal complex E-81 from Orient Chemical Industries Co., Ltd.) and 900 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the cyan master batch 1 and 500 parts of ethyl acetate were added to the mixture and mixed for 1 hr to prepare a material solution 1.

1,000 parts of the material solution 1 were transferred into another vessel, and the carbon black and wax therein were dispersed by a T.K. homomixer from Tokushu Kika Kogyo Co., Ltd. at 12,000 rpm for 30 min. Next, 1,000 parts of an ethyl acetate solution of the low-molecular-weight polyester 1 having a concentration of 65% were added to the material solution 1 and the mixture was stirred by the homomixer in the same conditions to prepare a pigment and wax dispersion liquid 1.

Example 1

648 parts of the pigment and wax dispersion liquid 1, 154 parts of the prepolymer 1 and 6.6 parts of the ketimine compound 1 were mixed in a vessel by a T.K. homomixer from Tokushu Kika Kogyo Co., Ltd. at 7,000 rpm for 1 min. 1,200 parts of the aqueous phase 1 were added to the mixture and mixed by the T.K. homomixer at 13,000 rpm for 30 min to prepare an emulsified slurry 1.

The emulsified slurry 1 was put in a vessel including a stirrer and a thermometer. After a solvent was removed from the emulsified slurry 1 at 30° C. for 8 hrs, the slurry was aged at 45° C. for 4 hrs to prepare a dispersion slurry 1. The dispersion slurry 1 had a volume-average particle diameter of 5.4 μm, and a number-average particle diameter of 4.40 μm when measured by Multisizer II.

After the dispersion slurry 1 was filtered under reduced pressure, 100 parts of ion exchanged water were added thereto and mixed by the T.K. homomixer at 12,000 rpm for 10 min, and the mixture was filtered. This operation was repeated for 5 times to remove impurities and prepare a filtered cake 1.

The filtered cake 1 was dried by an air drier at 45° C. for 48 hrs and sieved by a mesh having an opening of 75 μm to prepare toner 1 having a volume-average particle diameter (Dv) of 5.2 μm, a number-average particle diameter (Dn) of 4.42 μm and a ratio (Dv/Dn) of 1.18 when measured by Multisizer II.

Example 2

The procedures of preparation for the toner 1 were repeated except for performing ultrasonic alkali washing once before washing with ion exchanged water to prepare a toner 2 having a volume-average particle diameter (Dv) of 4.80 μm, a number-average particle diameter (Dn) of 4.32 μm and a ratio (Dv/Dn) of 1.11.

Example 3

The procedures of preparation for the toner 1 were repeated except for changing the rice wax to candelilla wax in Production Example 7 to prepare a toner 3 having a volume-average particle diameter (Dv) of 5.80 μm, a number-average particle diameter (Dn) of 5.17 μm and a ratio (Dv/Dn) of 1.12.

Production Example 8

262 parts of an adduct of bisphenol A with 2 moles of ethyleneoxide, 202 parts of an adduct of bisphenol A with 2 moles of propyleneoxide, 236 parts of an adduct of bisphenol A with 3 moles of propyleneoxide, 266 parts terephthalic acid and 2 parts of dibutyltinoxide were mixed and reacted in a reactor vessel including a cooling pipe, a stirrer and a nitrogen inlet pipe for 8 hrs at a normal pressure and 210° C. Further, after the mixture was depressurized by 10 to 15 mm Hg and reacted for 5 hrs, 34 parts of phthalic acid anhydride were added thereto and reacted for 2 hrs at 180° C. and a normal pressure to prepare low-molecular-weight polyester 2. The low-molecular-weight polyester 1 had a number-average molecular weight of 1,850, a weight-average molecular weight of 8,520, a Tg of 53° C. and an acid value of 20.7.

Production Example 9

349 parts of the low-molecular-weight polyester 2, 110 parts of carnauba wax, 22 parts of charge controlling agent (salicylic acid metal complex E-81 from Orient Chemical Industries Co., Ltd.) and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the cyan master batch 1 and 500 parts of ethyl acetate were added to the mixture and mixed for 1 hr to prepare a material solution 2.

1,324 parts of the material solution 2 were transferred into another vessel, and the carbon black and wax therein were dispersed by a T.K. homomixer from Tokushu Kika Kogyo Co., Ltd. at 10,000 rpm for 30 min. Next, 1,324 parts of an ethyl acetate solution of the low-molecular-weight polyester 2 having a concentration of 65% were added to the material solution 2 and the mixture was stirred by the homomixer in the same conditions to prepare a pigment and wax dispersion liquid 2.

Example 4

The procedures of preparation for the toner 1 were repeated except for changing the pigment and wax dispersion liquid 1 to pigment and wax dispersion liquid 2 performing alkali washing twice without application of ultrasound before washing with ion exchanged water to prepare a toner 4 having a volume-average particle diameter (Dv) of 5.10 μm, a number-average particle diameter (Dn) of 4.44 μm and a ratio (Dv/Dn) of 1.14.

Example 5

The procedures of preparation for the toner 1 were repeated except for performing alkali washing once without application of ultrasound before washing with ion exchanged water to prepare a toner 5 having a volume-average particle diameter (Dv) of 6.32 μm, a number-average particle diameter (Dn) of 5.37 μm and a ratio (Dv/Dn) of 1.15.

Production Example 10

719 parts of an adduct of bisphenol A with 2 moles of propyleneoxide, 274 parts terephthalic acid and 2 parts of dibutyltinoxide were mixed and reacted in a reactor vessel including a cooling pipe, a stirrer and a nitrogen inlet pipe for 8 hrs at a normal pressure and 210° C. Further, after the mixture was depressurized by 20 to 65 mm Hg and reacted for 5 hrs, 7 parts of phthalic acid anhydride were added thereto and reacted for 2 hrs at 180° C. and a normal pressure to prepare low-molecular-weight polyester 3. The low-molecular-weight polyester 1 had a number-average molecular weight of 3,200, a weight-average molecular weight of 9,200, a Tg of 54° C. and an acid value of 8.5.

Production Example 11

378 parts of the low-molecular-weight polyester 3, 110 parts of carnauba wax, 10 parts of charge controlling agent (salicylic acid metal complex E-84 from Orient Chemical Industries Co., Ltd.) and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the master batch 1 and 500 parts of ethyl acetate were added to the mixture and mixed for 1 hr to prepare a material solution 3.

1,324 parts of the material solution 3 were transferred into another vessel, and a pigment and a wax thereof were dispersed by a beads mill (an ultra visco mill from Imecs Co., Ltd.) filled with zirconia beads having a diameter of 0.5 mm by 80 volume % on the condition of 3 passes at a liquid feeding speed of 1 kg/hr and a disk peripheral speed of 6 m/sec. Next, 1,324 parts of an ethyl acetate solution of the low-molecular-weight polyester 3 having a concentration of 65% were added to the material solution 3 and the mixture was milled by the beads mill at one time to prepare a pigment and wax dispersion liquid 3.

Example 6

The procedures of preparation for the toner 1 were repeated except for changing the pigment and wax dispersion liquid 1 to pigment and wax dispersion liquid 3 and performing alkali washing for 4 times without application of ultrasound before washing with ion exchanged water to prepare a toner 6 having a volume-average particle diameter (Dv) of 5.80 μm, a number-average particle diameter (Dn) of 4.95 μm and a ratio (Dv/Dn) of 1.17.

Example 7

The procedures of preparation for the toner 1 were repeated except for changing the pigment and wax dispersion liquid 1 to pigment and wax dispersion liquid 3 and performing alkali washing twice without application of ultrasound before washing with ion exchanged water to prepare a toner 7 having a volume-average particle diameter (Dv) of 6.20 μm, a number-average particle diameter (Dn) of 5.20 μm and a ratio (Dv/Dn) of 1.19.

Production Example 12

121 parts of an adduct of bisphenol A with 2 moles of ethyleneoxide, 64 parts of an adduct of bisphenol A with 2 moles of propyleneoxide, 527 parts of an adduct of bisphenol A with 3 moles of propyleneoxide, 246 parts terephthalic acid, 48 parts of adipic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 42 parts of trimellitic acid anhydride were added thereto and reacted for 2 hrs at 180° C. and a normal pressure to prepare low-molecular-weight polyester 4. The low-molecular-weight polyester 1 had a number-average molecular weight of 2,100, a weight-average molecular weight of 14,000, a Tg of 48° C. and an acid value of 27.3.

Production Example 13

378 parts of the low-molecular-weight polyester 4, 110 parts of carnauba wax, 22 parts of charge controlling agent (salicylic acid metal complex E-84 from Orient Chemical Industries Co., Ltd.) and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the master batch 1 and 500 parts of ethyl acetate were added to the mixture and mixed for 1 hr to prepare a material solution 4.

1,324 parts of the material solution 43 were transferred into another vessel, and a pigment and a wax thereof were dispersed by a beads mill (an ultra visco mill from Imecs Co., Ltd.) filled with zirconia beads having a diameter of 0.5 mm by 80 volume % on the condition of 3 passes at a liquid feeding speed of 1 kg/hr and a disk peripheral speed of 6 m/sec. Next, 1,324 parts of an ethyl acetate solution of the low-molecular-weight polyester 3 having a concentration of 65% were added to the material solution 3 and the mixture was milled by the beads mill at one time to prepare a pigment and wax dispersion liquid 4.

Example 8

The procedures of preparation for the toner 1 were repeated except for changing the pigment and wax dispersion liquid 1 to pigment and wax dispersion liquid 4 to prepare a toner 8 having a volume-average particle diameter (Dv) of 4.80 μm, a number-average particle diameter (Dn) of 4.00 μm and a ratio (Dv/Dn) of 1.20.

Example 9

The procedures of preparation for the toner 1 were repeated except for changing the pigment and wax dispersion liquid 1 to pigment and wax dispersion liquid 4 and performing ultrasonic alkali washing once before washing with ion exchanged water to prepare a toner 9 having a volume-average particle diameter (Dv) of 5.11 μm, a number-average particle diameter (Dn) of 4.45 μm and a ratio (Dv/Dn) of 1.15.

Comparative Example 1

After 451 g of 0. 1M-$Na_3PO_4$ were put in 709 g of ion exchange water and the mixture was heated to have a temperature of 60° C., the mixture was stirred by a T.K. homomixer at 12,000 rpm. 68 g of 1.0M-$CaCl_2$ were gradually added to the mixture to prepare an aqueous medium including $Ca_3(PO_4)_2$. 170 g of styrene, 30 g of 2-ethylhexylacrylate, 10 g of Regal 400R, 60 g of paraffin wax having a softening point of 70° C., 5 g of a di-tert-butylsalicylic acid metal compound and 10 g of a styrene-methacrylic acid copolymer having a weight-average molecular weight of 50,000 and an acid value of 20 mg KOH/g were uniformly dissolved and dispersed by a T.K. homomixer at 12,000 rpm and 60° C. 10 g of a polymerization initiator, i.e., 2,2'-azobis (2,4-dimethylvaleronitrile) were dissolved in the mixture to prepare a unit of polymerizing monomers. The unit of polymerizing monomers was put in the aqueous medium and the mixture was stirred by a T.K. homomixer at 10,000 rpm and 60° C. for 20 min in a $N_2$ environment to granulate the unit of polymerizing monomers. Then, after the mixture was reacted at 60° C. for 3 hrs while stirred with a paddle stirring blade, the mixture was further reacted at 80° C. for 10 hrs. After the polymerization reaction, the mixture was cooled and a hydrochloric acid was added thereto. Further, after calcium phosphate was dissolved in the mixture, the mixture was filtered, washed with water and dried to prepare a toner 10 having a volume-average particle diameter (Dv) of 6.30 μm, a number-average particle diameter (Dn) of 5.64 μm and a ratio (Dv/Dn) of 1.12.

Comparative Example 2

Production Example 14

In a 4-head flask having a stirrer, a temperature sensor, a nitrogen inlet pipe, a cooling pipe and a capacity of 1,000 ml, 500 ml of deaerated and distilled water, 28.5 g of 565C from Nippon Nyukazai, Co., Ltd. and 185.5 g of candelilla wax No. 1 from Noda Wax Co., Ltd. were put in a nitrogen stream and heated while stirred. When an inner temperature of the mixture was 85° C., 5N-sodium hydrate was added thereto and the mixture was heated to have a temperature of 75° C. Then, the mixture was stirred upon application of heat for 1 hr and cooled to have a room temperature to prepare a wax particle aqueous dispersion 1.

100 g of carbon black Mogal L from Cabot corp. and 25 g of dodecylsodiumsulfate were added in 540 ml of distilled water. After the mixture was sufficiently stirred, the mixture was dispersed by a pressurization disperser to prepare a colorant dispersion liquid 1.

Production Example 15

In a 4-head flask having a stirrer, a cooling pipe, a temperature sensor, nitrogen inlet pipe and a capacity of 1,000 ml, 480 ml of distilled water, 0.6 g of dodecyl sodium sulfate, 106.4 g of styrene, 43.2 g of n-butylacrylate and 10.4 g of methacrylic acid were put in a nitrogen stream and heated while stirred to have a temperature of 70° C. Then, an aqueous solution of an initiator in which 2.1 g of potassium persulfate were dissolved in 120 ml of distilled water was added to the mixture and the mixture was stirred in a nitrogen stream at 70° C. for 3 hrs. After the polymerization was completed, the mixture was cooled to have a room temperature to prepare a polymer binder particulate dispersion liquid 1.

In a 4-head flask having a stirrer, a cooling pipe, a temperature sensor, nitrogen inlet pipe and a capacity of 5,000 ml, 2,400 ml of distilled water, 2.8 g of dodecyl sodium sulfate, 620 g of styrene, 128 g of n-butylacrylate, 52 g of methacrylic acid an 27.4 g of tert-dodecylmercaptan were put in a nitrogen stream and heated while stirred to have a temperature of 70° C. Then, an aqueous solution of an initiator in which 11.2 g of potassium persulfate were dissolved in 600 ml of distilled water was added to the mixture and the mixture was stirred in a nitrogen stream at 70° C. for 3 hrs. After the polymerization was completed, the mixture was cooled to have a room temperature to prepare a low-molecular-weight binder particulate dispersion liquid 2.

Production Example 16

In a separable flask having a stirrer, a cooling pipe, a temperature sensor and a capacity of 1,000 ml, 47.6 g of the polymer binder particulate dispersion liquid 1, 190.5 of the low-molecular-weight binder particulate dispersion liquid 2, 7.7 g of the wax particle aqueous dispersion 1, 26.7 g of the colorant dispersion liquid 1 and 252.5 ml of distilled water were mixed and stirred, and an aqueous solution of 5N-sodium hydrate was added in the mixture to have a pH of 9.5. Further, an aqueous solution of sodium chloride in which 50 g of sodium chloride were dissolved in 600 ml of distilled water, 77 ml of isopropanol and a surfactant aqueous solution in which 10 mg of fluorine nonion surfactant FC-170C from Sumitomo 3M Ltd. is dissolved in 10 ml of distilled water were added to the mixture in this order. Then, the mixture was reacted at 85° C. for 6 hrs and cooled to have a room temperature. After an aqueous solution of 5N-sodium hydrate was added in the mixture to have a pH of 13, the mixture was filtered and suspended in distilled water. After the mixture was repeatedly filtered and suspended, the mixture was washed and dried to prepare a toner 11 having a volume-average particle diameter (Dv) of 6.52 μm, a number-average particle diameter (Dn) of 5.31 μm and a ratio (Dv/Dn) of 1.23.

0.7 parts of hydrophobic silica and 0.3 parts of hydrophobic titanium oxide were mixed with 100 parts of the respective toners 1 to 11 by a HENSCHEL MIXER.

A developer including 5 parts by weight of the toner including the above-mentioned external additives, i.e., the hydrophobic silica and titanium oxide and 95 parts by weight of copper-zinc ferrite carrier coated with a silicone resin and having an average-particle diameter of 40 μm was prepared, and copies are continuously produced by imagio Neo 450 capable of producing 45 A4 size copies from Ricoh Company, Ltd. using the developer.

Evaluation results of the following items are shown in Tables 1 to 4.

(a) Particle Diameter

The volume-average and number-average particle diameter of the toner were measured by Coulter Counter TA-II from Coulter Electronics, Inc. using an aperture of 100 μm.

(b) Charge Amount 6 g of the developer was put in a sealed metallic cylinder and blown to determine charge amount thereof. The toner concentration was from 4.5 to 5.5% by weight.

(c) Fixability

Solid images having a toner of 1.0±01 mg/cm$_2$ were produced on a plain paper transfer sheet RICOH TYPE 6200 and a cardboard transfer sheet NBS RICOH <135> by imagio Neo 450 having a changeable fixing belt temperature. A temperature at which the offset does not occur was determined using the plain paper and a fixable minimum temperature was determined using the card board. A fixing roller temperature at which a fixed image has an image density not less than 70% after scraped with a pat was determined as the fixable minimum temperature.

(d) Circularity

A flow-type particle image analyzer FPIA-2000 from SYSMEX CORPORATION can measure an average circularity. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

(e) Particulate Resin Material Coverage

Several electron microscope photographs having a magnification of 50,000 of a toner surface were taken. Surfaces having less slopes and cracks were selected from the photographs and coverage of the particulate resin material over the toner surface was determined by an area ratio thereof using an image analyzer Luzex III. An average of 50 particles was determined as the coverage.

(f) Tg

TG-DSC system TAS-100 from Rigaku Corp. was used to measure Tg.

First, about 10 mg of a sample in an aluminium container was loaded on a holder unit, which was set in an electric oven. After the sample was heated in the oven at from a room temperature to 150° C. and a programming speed of 10° C./min, the sample was left for 10 min at 150° C. After the samples was cooled to have a room temperature and left for 10 min, the sample was heated again in a nitrogen environment to have a temperature of 150° C. at a programming speed of 10° C./min and DSC measurement of the sample was performed. Tg was determined from a contact point between a tangent of a heat absorption curve close to Tg and base line using an analyzer in TAS-100.

(g) Image Density

Image density of 5 points of a solid image were measured by X-Rite from X-Rite, Inc.

(h) Background Fouling

An image forming process was stopped while a blank image was developed to adhere a developer on a photoreceptor to an adhesive tape before the image was transferred. A difference of image density between the adhesive tape the developer adhered to and a blank adhesive tape was measured by 938 spectrodensitometer from X-Rite, Inc.

(i) Cleanability

A residual toner after transfer on a photoreceptor after cleaned was adhered on a Scotch Tape from Sumitomo 3M Ltd. and transferred onto a white paper. Density of the white paper was measured by Macbeth reflection densitometer RD514. When a density difference between the white paper the residual toner was transferred to and a blank white paper was not greater than 0.01, the cleanability was determined as good (○). When greater than 0.01, the cleanability was determined as poor (X).

(j) Filming

Toner filming over a developing roller or a photoreceptor was observed. ○ was no filming, Δ is a stripe filming and X is a whole filming.

TABLE 1

| | | Toner particle diameter | | | | | Charge amount |
|---|---|---|---|---|---|---|---|
| | | Dv (μm) | Dn (μm) | Dv/Dn | Circularity | Coverage (5) | (−μC/g) |
| Ex. 1 | Toner 1 | 5.21 | 4.42 | 1.18 | 0.951 | 85.0 | 23.5 |
| Ex. 2 | Toner 2 | 4.80 | 4.32 | 1.11 | 0.953 | 69.0 | 24.1 |
| Ex. 3 | Toner 3 | 5.80 | 5.17 | 1.12 | 0.957 | 85.0 | 25.4 |
| Ex. 4 | Toner 4 | 5.10 | 4.44 | 1.15 | 0.949 | 75.0 | 26.5 |
| Ex. 5 | Toner 5 | 6.32 | 5.37 | 1.18 | 0.945 | 84.0 | 27.8 |
| Ex. 6 | Toner 6 | 5.80 | 4.95 | 1.17 | 0.956 | 68.0 | 25.9 |
| Ex. 7 | Toner 7 | 6.20 | 5.20 | 1.19 | 0.955 | 84.0 | 27.1 |
| Ex. 8 | Toner 8 | 4.80 | 4.00 | 1.20 | 0.954 | 82.0 | 24.2 |
| Ex. 9 | Toner 9 | 5.11 | 4.45 | 1.15 | 0.956 | 75.0 | 25.1 |
| Com. Ex. 1 | Toner 10 | 6.30 | 5.65 | 1.12 | 0.983 | — | 27.4 |
| Com. Ex. 2 | Toner 11 | 6.52 | 5.31 | 1.23 | 0.960 | — | 26.8 |

TABLE 2

| | | Image density | | | Background fouling | | |
|---|---|---|---|---|---|---|---|
| | Fine dot reproducibility | Start | After 10,000 | After 100,000 | Start | After 10,000 | After 100,000 |
| Ex. 1 | ◎ | 1.41 | 1.45 | 1.42 | 0.01 | 0.01 | 0.0 |
| Ex. 2 | ◎ | 1.38 | 1.41 | 1.41 | 0.01 | 0.00 | 0.01 |
| Ex. 3 | ◎ | 1.36 | 1.39 | 1.39 | 0.00 | 0.00 | 0.01 |

TABLE 2-continued

| | Fine dot reproducibility | Image density Start | After 10,000 | After 100,000 | Background fouling Start | After 10,000 | After 100,000 |
|---|---|---|---|---|---|---|---|
| Ex. 4 | ◎ | 1.36 | 1.39 | 1.39 | 0.00 | 0.00 | 0.00 |
| Ex. 5 | ◎ | 1.37 | 1.38 | 1.38 | 0.00 | 0.00 | 0.01 |
| Ex. 6 | ○ | 1.39 | 1.41 | 1.42 | 0.01 | 0.00 | 0.00 |
| Ex. 7 | ○ | 1.38 | 1.40 | 1.38 | 0.00 | 0.00 | 0.01 |
| Ex. 8 | ◎ | 1.42 | 1.43 | 1.42 | 0.01 | 0.01 | 0.00 |
| Ex. 9 | ○ | 1.41 | 1.41 | 1.41 | 0.00 | 0.00 | 0.00 |
| Com. Ex. 1 | ◎ | 1.28 | — | — | 0.02 | — | — |
| Com. Ex. 2 | ○ | 1.36 | 1.44 | — | 0.02 | 0.41 | — |

TABLE 3

| | Cleanability Start | After 10,000 | After 100,000 | Filming After 100,000 | Charge amount (−μC/g) Start | After 10,000 | After 100,000 |
|---|---|---|---|---|---|---|---|
| Ex. 1 | ○ | ○ | ○ | ○ | 30.1 | 29.5 | 30.3 |
| Ex. 2 | ○ | ○ | ○ | ○ | 31.6 | 30.2 | 31.7 |
| Ex. 3 | ○ | ○ | ○ | ○ | 30.5 | 30.6 | 31.2 |
| Ex. 4 | ○ | ○ | ○ | ○ | 32.6 | 30.5 | 30.1 |
| Ex. 5 | ○ | ○ | ○ | ○ | 33.6 | 30.2 | 29.4 |
| Ex. 6 | ○ | ○ | ○ | ○ | 31.9 | 30.7 | 30.4 |
| Ex. 7 | ○ | ○ | ○ | ○ | 34.2 | 31.5 | 29.7 |
| Ex. 8 | ○ | ○ | ○ | ○ | 32.6 | 33.2 | 32.7 |
| Ex. 9 | ○ | ○ | ○ | ○ | 33.3 | 32.8 | 32.6 |
| Com. Ex. 1 | X | — | — | — | 32.5 | — | — |
| Com. Ex. 2 | ○ | ○ | — | — | 34.6 | 16.7 | — |

TABLE 4

| | Visco-elasticity G'80(Pa) | G'180(Pa) | G'80/G'180 | Fixable minimum temperature (° C.) | Offset (° C.) | Comprehensive evaluation |
|---|---|---|---|---|---|---|
| Ex. 1 | $3.3 \times 10^6$ | $1.2 \times 10^3$ | 2,750 | 140 | 220 | ○ |
| Ex. 2 | $1.5 \times 10^6$ | $9.5 \times 10^2$ | 1,579 | 140 | 220 | ○ |
| Ex. 3 | $4.5 \times 10^5$ | $7.5 \times 10^2$ | 600 | 130 | 220 | ○ |
| Ex. 4 | $5.5 \times 10^5$ | $1.1 \times 10^3$ | 500 | 135 | 220 | ○ |
| Ex. 5 | $6.5 \times 10^6$ | $2.5 \times 10^3$ | 2,600 | 150 | 230 | ○ |
| Ex. 6 | $3.1 \times 10^6$ | $1.7 \times 10^3$ | 1,824 | 145 | 230 | ○ |
| Ex. 7 | $6.5 \times 10^6$ | $2.7 \times 10^3$ | 2,407 | 150 | 220 | ○ |
| Ex. 8 | $2.0 \times 10^6$ | $1.3 \times 10^3$ | 1,538 | 140 | 220 | ○ |
| Ex. 9 | $3.0 \times 10^6$ | $1.1 \times 10^3$ | 2,727 | 140 | 220 | ○ |
| Com. Ex. 1 | $5.5 \times 10^7$ | $8.1 \times 10^2$ | 67,901 | 190 | 200 | X |
| Com. Ex. 2 | $3.2 \times 10^7$ | $2.3 \times 10^3$ | 13,913 | 175 | 225 | X |

This document claims priority and contains subject matter related to Japanese Patent Application No. 2002-349008 filed on Nov. 29, 2002, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles comprising:

a first binder resin;

a second binder resin different from said first binder resin and having a glass transition temperature of from 40 to 55° C.;

a colorant; and release agent, and a particulate resin material having a volume average molecular weight of from 1,000 to 100,000 located on a surface of the toner particles with a coverage of from 50 to 100%, and which has a glass transition temperature of from 50 to 90° C., wherein a weight ratio (W2/W1) between the second binder resin (W2) and the first binder resin (W1) is from 5/95 to 40/60, and wherein a ratio of a storage modulus of the toner at 80° C. and a storage modulus of the toner at 180° C. is from 100 to 2,750.

2. The toner of claim 1, wherein the storage modulus of the toner at 80° C. is from $1\times10^5$ to $5\times10^7$ Pa and the storage modulus of the toner at 180° C. is from $5\times10^2$ to $3\times10^3$ Pa.

3. The toner of claim 1, wherein the storage modulus of the toner at 80° C. is from $1\times10^5$ to $5\times10^6$ Pa and the storage modulus of the toner at 180° C. is from $5\times10^2$ to $3\times10^3$ Pa.

4. The toner of claim 1, wherein the first binder resin comprises a polyester resin.

5. The toner of claim 1, wherein the second binder resin comprises a modified polyester resin.

6. The toner of claim 1, having a volume-average particle diameter of from 4.0 to 7.0 μm.

7. The toner of claim 6, wherein a ratio (Dv/Dn) between the volume-average particle diameter (Dv) and a number-average particle diameter (Dn) of the toner is from 1.00 to 1.20.

8. The toner of claim 1, wherein the first binder resin has an acid value of from 1 to 30 mg KOH/g.

9. The toner of claim 1, wherein the particulate resin material is a resin selected from the group consisting of vinyl resins, polyurethane resins, epoxy resins and polyester resins.

10. The toner of claim 1, wherein the particulate resin material has an average particle diameter of from 5 to 200 nm.

11. The toner of claim 1, having an average circularity of from 0.940 to 1.000.

12. The toner of claim 1, having a spindle shape.

13. The toner of claim 12, wherein a ratio ($r_2/r_1$) between a major axis particle diameter ($r_1$) and a minor axis particle diameter ($r_2$) of the toner is from 0.5 to 0.8 and a ratio ($r_3/r_2$) between a thickness ($r_3$) and the minor axis particle diameter ($r_2$) thereof is from 0.7 to 1.0.

14. A developer comprising a carrier and the toner according to claim 1.

15. A container containing the toner according to claim 1.

16. A container containing the developer according to claim 14.

17. A method of producing the toner according to claim 1, comprising:

dissolving or dispersing a toner composition comprising the first binder resin and the second binder resin comprising a modified polyester resin in an organic solvent to prepare a solution or a dispersion;

mixing the solution or the dispersion with a compound having an active hydrogen atom in an aqueous medium comprising the particulate resin material to react the modified polyester with the compound to prepare a reactant;

removing the organic solvent from the reactant to prepare the toner particles; and washing the toner particles to remove excessive particles of the particulate resin material from a surface thereof.

* * * * *